US007870909B2

(12) United States Patent
John et al.

(10) Patent No.: US 7,870,909 B2
(45) Date of Patent: Jan. 18, 2011

(54) DEPLOYABLE ZONAL ISOLATION SYSTEM

(75) Inventors: Colin P. John, Baku (AZ); Geoffrey R. Kernick, Wanaka (NZ); Vincent Rodet, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 188 days.

(21) Appl. No.: 11/309,012

(22) Filed: Jun. 8, 2006

(65) Prior Publication Data

US 2007/0056750 A1 Mar. 15, 2007

Related U.S. Application Data

(60) Provisional application No. 60/688,843, filed on Jun. 9, 2005.

(51) Int. Cl.
*E21B 33/12* (2006.01)

(52) U.S. Cl. ..... 166/387; 166/313

(58) Field of Classification Search ..... 166/387, 166/227, 236, 114, 278, 51, 313, 115
See application file for complete search history.

(56) References Cited

U.S. PATENT DOCUMENTS

| | | | | | |
|---|---|---|---|---|---|
| 2,425,202 | A * | 8/1947 | Ozinga | 166/114 |
| 2,891,623 | A * | 6/1959 | Boss | 166/205 |
| 2,963,088 | A * | 12/1960 | Corley, Jr. | 166/297 |
| 3,059,969 | A * | 10/1962 | Schliephacke | 297/321 |
| 3,601,192 | A * | 8/1971 | Layne et al. | 166/232 |
| 4,137,970 | A * | 2/1979 | Laflin et al. | 166/292 |
| 4,299,281 | A * | 11/1981 | Long et al. | 166/135 |
| 4,600,056 | A * | 7/1986 | Burton, Jr. | 166/291 |
| 4,612,985 | A * | 9/1986 | Rubbo et al. | 166/114 |
| 4,735,266 | A * | 4/1988 | Stone et al. | 166/313 |
| 4,936,386 | A * | 6/1990 | Colangelo | 166/292 |
| 5,058,684 | A * | 10/1991 | Winslow et al. | 166/386 |
| 6,848,505 | B2 | 2/2005 | Richard | |
| 6,854,522 | B2 | 2/2005 | Brezinski | |
| 6,883,610 | B2 * | 4/2005 | Depiak | 166/308.1 |
| 6,907,937 | B2 | 6/2005 | Whanger | |
| 6,935,432 | B2 | 8/2005 | Nguyen | |
| 7,013,979 | B2 | 3/2006 | Richard | |
| 7,258,166 | B2 * | 8/2007 | Russell | 166/229 |
| 2002/0074119 | A1 * | 6/2002 | Bixenman et al. | 166/278 |
| 2005/0067170 | A1 * | 3/2005 | Richard | 166/387 |
| 2005/0199401 | A1 * | 9/2005 | Patel et al. | 166/387 |
| 2006/0042801 | A1 * | 3/2006 | Hackworth et al. | 166/387 |
| 2006/0185849 | A1 * | 8/2006 | Edwards et al. | 166/296 |
| 2007/0227733 | A1 * | 10/2007 | Vercaemer et al. | 166/292 |
| 2007/0240877 | A1 * | 10/2007 | O'Malley et al. | 166/179 |
| 2008/0023205 | A1 * | 1/2008 | Craster et al. | 166/387 |

OTHER PUBLICATIONS

Easy Well Solutions.: "Swellable Packer", 2005.

* cited by examiner

*Primary Examiner*—David J Bagnell
*Assistant Examiner*—Cathleen R Hutchins
(74) *Attorney, Agent, or Firm*—Winstead, P.C.; David G. Matthews; Kevin B. McGoff

(57) ABSTRACT

A method of providing zonal isolation in a wellbore completion includes the steps of identifying an anticipated zone for isolation in a wellbore before completing the wellbore; selecting, before completing the wellbore, a completion assembly and a cooperative deployable isolation assembly to isolate the anticipated zone; completing the wellbore with the selected completion assembly; and connecting the selected deployable isolation assembly in the selected completion assembly to isolate the anticipated zone.

10 Claims, 3 Drawing Sheets

DEPLOYABLE ZONAL ISOLATION SYSTEM

RELATED APPLICATIONS

This application claims the benefit of U.S. Provisional Patent Application No. 60/688,843 filed on Jun. 9, 2005.

FIELD OF THE INVENTION

The present invention relates in general to wellbore operations and more particular to a system for using a deployable isolation assembly to isolate selected zones in a wellbore.

BACKGROUND

Wellbores are often drilled through and completed for production and/or injection in multiple formations or zones of formations. Commonly, during the life of the wellbore it is desirable or necessary to isolate one or more of the zones. Prior systems isolation systems often require rigging up to isolate the desired zone. Additionally, often the prior art isolation systems result in a significant reduction in the flow path through the completed section of the well.

It is therefore a desire to provide a simple, easily deployable and stackable zonal isolation solution.

SUMMARY OF THE INVENTION

A deployable zonal isolation system and method for isolating zones in a wellbore is provided. In one embodiment, a method of providing zonal isolation in a wellbore completion includes the steps of identifying an anticipated zone for isolation in a wellbore before completing the wellbore; selecting, before completing the wellbore, a completion assembly and a cooperative deployable isolation assembly to isolate the anticipated zone(s); completing the wellbore with the selected completion assembly; and connecting the selected deployable isolation assembly in the selected completion assembly to isolate the anticipated zone.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
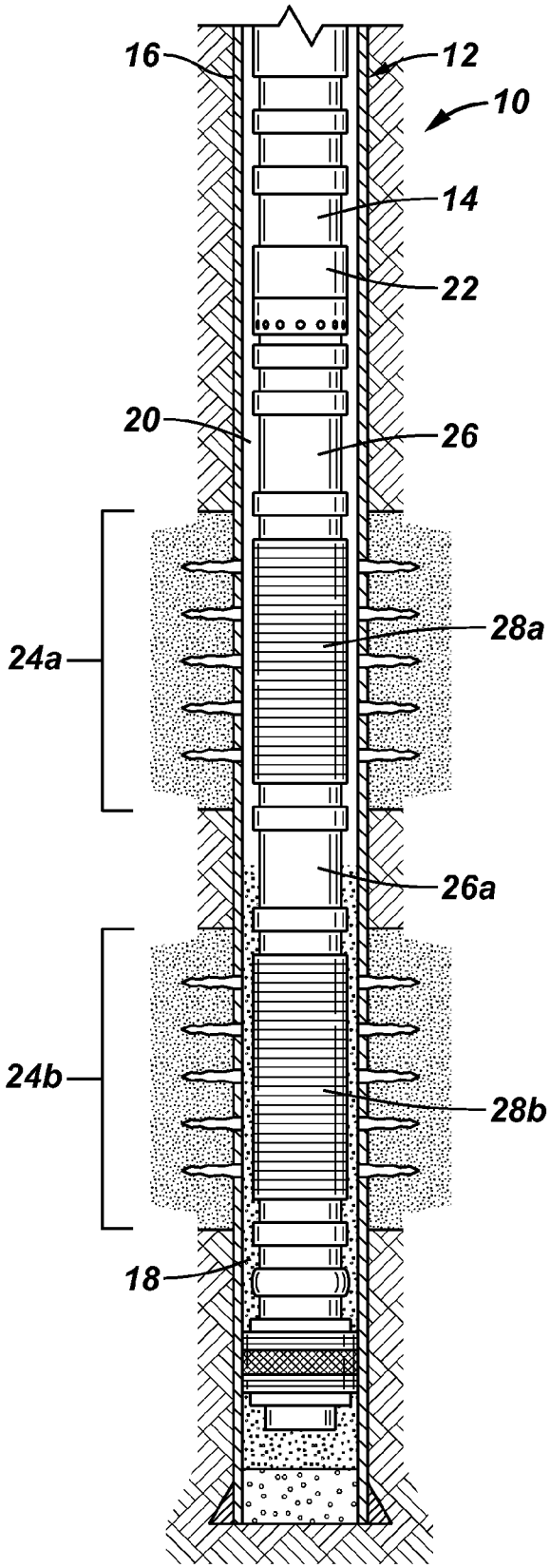
FIG. 1 is a schematic of a wellbore completed with an embodiment of the completion assembly of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 is a schematic of a wellbore 12 completed with an embodiment of a selected completion assembly 14 of deployable zonal isolation system of the present invention, generally designated by the numeral 10. In the illustrated embodiment, wellbore 12 is a gravel pack completion including casing 16. As is well known in the art, gravel 18 is disposed in annulus 20 between casing 16 and completion assembly 14 by pumping a gravel 18 laden slurry through cross-over 22. It should be noted that although the invention is illustrated with a cased gravel pack completion, the invention is applicable for open hole gravel packing and non-gravel packed completions.

Wellbore 12 is drilled into the earth having multiple formation zones 24 of interest. In FIG. 1, wellbore 12 includes a first zone 24*a* and a second zone 24*b* from which it is desired to produce hydrocarbons. In the present example, prior to the completion of wellbore 12 it is anticipated that during the production life of wellbore 12 that water will first encroach at zone 24*b* and will encroach later in time at zone 24*a*. Thus, completion assembly 14 is selected and design for isolating zones 24*a* and 24*b* during the production life of the well.

Flow sections 28 are positioned within completion assembly 14 so as to be positioned adjacent the respective formation zones 24 upon completion of wellbore 12. In anticipation of isolating flow sections 28, one or more receivers 26 are incorporated into completion assembly 14. As illustrated, a receiver 26*b* is positioned below flow section 28*b* and a receiver 26*a* is positioned between flow sections 28*a* and 28*b*. Each of the receivers 26 is adapted to position an isolation assembly 30 (FIG. 3) proximate a respective flow section 28 and flow zone 24. As will be further understood with the following description, completion assembly 14 may include a single receiver 26 for isolating multiple flow sections 28 over the life of the well.

Figure 2:
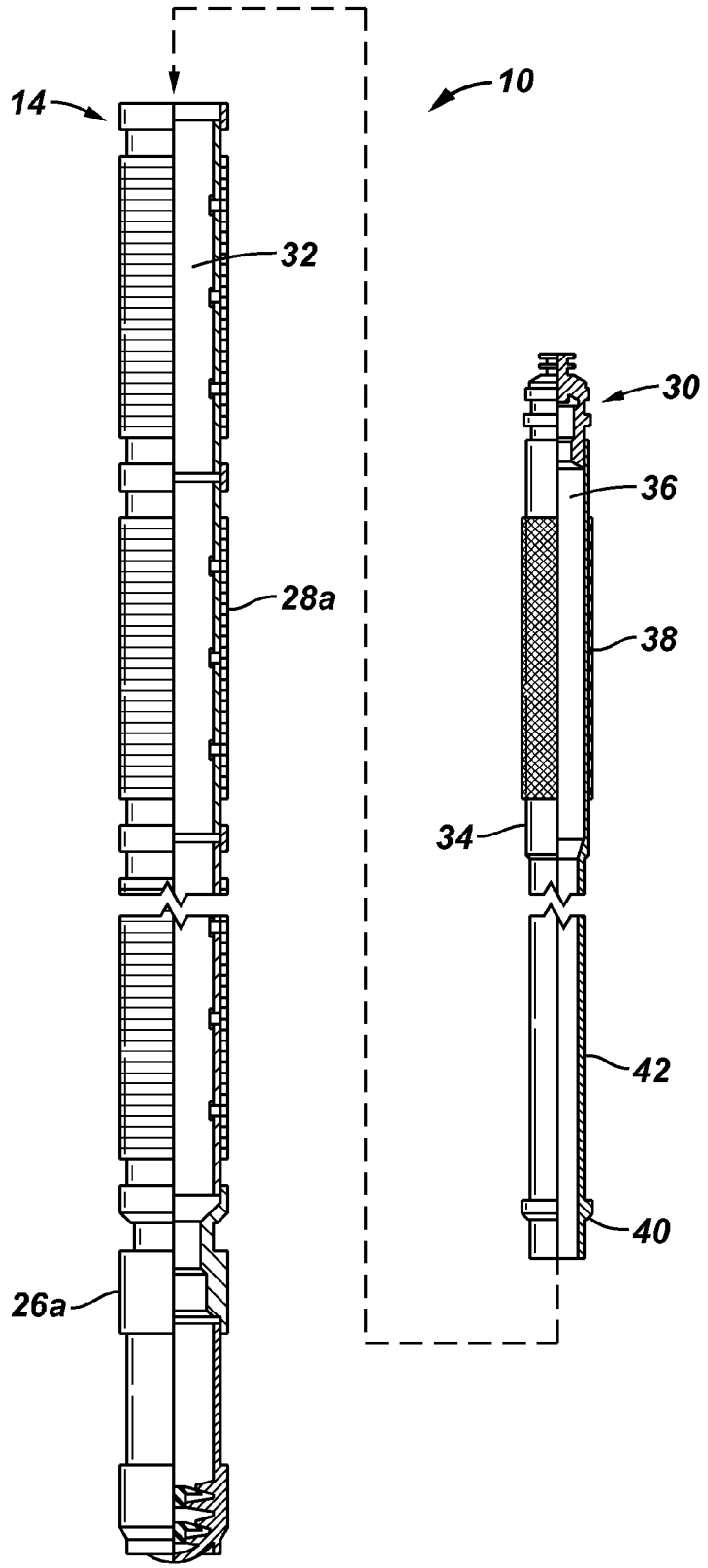
FIG. 2 is an exploded view of an embodiment of the deployable zonal isolation system.

FIG. 2 is an illustration of deployable isolation system 10 including selected completion assembly 14 and deployable isolation assembly 30. Completion assembly 14 is selected for a specific wellbore 12 and is adapted for accepting a cooperative deployable isolation assembly 30 to isolate a zone 24 during the production life of the well.

Flow sections 28 permit flow of fluid from the exterior of completion assembly 14 to its interior conduit 32. Flow sections 28 may be constructed in many manners and/or comprise various apparatus. Examples of flow sections 28, without limitation, include tubulars to be perforated at completion, pre-perforated tubulars, slotted liners and the various screen configurations.

Completion assembly 14 further includes one or more receivers 26. Receivers 26 are adapted to position deployable isolation assembly 30 proximate to flow section 28 which is anticipated to be isolated. The distance between each receiver 26 and a respective flow section 28 is noted for the selected isolation assembly 30. It is noted that completion assembly 14 may include other devices such as, but not limited to, valves and packers.

It should be noted that completion assembly 14 may comprise one elongated perforated tubular, wherein each flow section 28*a* and 28*b* is defined in relation to formation flow zones 24*a* or 24*b* or more specifically to portions of the formation that are expected to require isolation. As such, a single receiver 26 may be positioned for placement of a isolation assembly 30 in an isolation position of the lowest most flow section 28*b*. Then, over the production life, subsequent isolation assemblies may be stacked with the first isolation assembly to progressively isolate zones as they water out. Further, receivers 26 may be placed proximate to one or more anticipated flow sections 28 for positioning isolation assemblies 30.

Deployable isolation assembly 30 includes a mandrel 34 forming an internal bore 36 and a swellable material 38 disposed on its exterior. The length, diameter and other physical dimensions and properties of mandrel 34 and swellable material 38 are selected for positioning within interior 32 of selected completion assembly 14. Isolation assembly 30 may be deployed via tubing, coiled tubing, slick line or wireline.

Isolation assembly 30 further includes a locating device 40 selected in combination with a receiver 26 in completion assembly 30. As shown in FIG. 2, locating device 40 is a latching collet matable with latch profile 26 of completion assembly 14. Other locating devices 40, and cooperative receivers 26, may be utilized, such as, but not limited to, no-gos, snap latches, anchor latches and shearable anchor latches. A spacer 42 may be included in isolation assembly 30 to accurately position it relative to a receiver 26 and its respective flow section 28. It is noted that locating device 40 may be positioned above or below swellable material 38 to correspond to its respective receiver 26 and anticipated flow section 28 of completion assembly 14.

Deployable isolation assembly 30 may further include a receiver connector 44 adapted for mating with a locating and anchoring device 40 of a subsequent isolation assembly 30. In this configuration, as described above, one or more isolation assemblies 30 may be stacked one atop another to progressively isolate lengths of flow section 28. For example, a first isolation assembly 30 is run into completion assembly 14 and positioned via receiver 26*b* at flow section 28*b*. Later in the production life, as flow section 28*a* produces water, a subsequent isolation assembly 30 may be run into completion assembly 14 and connected via locating device 40 and receiver connector 44 to isolate flow section 28*a*.

Swellable material 38 is a material that expands upon contact with fluid in the wellbore. Swellable material 28 may be of various compositions including, but not limited to, nitrite, neoprene, natural rubber, and AFLAS. In an initial position, swellable material 38 has an outside diameter of less than the internal diameter of the interior 32 of completion assembly 14. Upon being positioned within completion assembly 14 and contacting the fluid in wellbore 12, material 38 expands to a sealing position. In the sealing position, swellable material 38 expands outwardly from mandrel 34 to completion assembly 14 sealing the annulus between the two assemblies.

With reference to FIGS. 1 and 2 an embodiment of a method of providing zonal isolation in a wellbore completion is described. Before completion of wellbore 12, the various formation zones 24 of interest are identified. Formation zones 24 that are anticipated to require isolation during the life of the well are identified. For example, it is anticipated that zone 24*b* will produce water first and then at a later date zone 24*a* will produce water and require isolation.

A completion assembly 14 is selected having flow sections 28*a* and 28*b* corresponding to flow zones 24*a* and 24*b* respectively. In one embodiment, a receiver 26*b* is positioned in completion assembly 14 at a known spacing below flow section 28*b*. A receiver 26*a* may also be positioned at a known location between flow sections 28*a* and 28*b* for either isolating flow section 28*a* after flow section 28*b* or for isolating flow section 28*a* instead of flow section 28*b*, for example when flow zones 24*a* and 24*b* are different producing formations.

A deployable isolation assembly 30 for the selected completion assembly 14 is selected. The selected deployable isolation assembly has a swellable material 38 with dimensions suitable for positioning in selected completion assembly 14 and of a length sufficient to seal across anticipated zone 24. A spacer 42 is selected of a length to position swellable material 38 across the desired flow section 28 relative to the selected receiver 26.

Wellbore 12 is completed with selected completion assembly 14. The completion may be open hole or include casing 16 has shown in FIG. 1. If wellbore 16 is cased, it is perforated at the desired section. The completion may further include gravel packing. Although the system of the present invention may be used in non-gravel packed wells, it is particularly suited and beneficial in gravel pack completions.

When it is desired to isolate anticipated zone 24*b*, such as due to excessive water production, selected isolation assembly 30 is deployed. Selected isolation assembly 30 is run into the interior 32 of completion assembly 14 via coiled tubing, slick line, wire line or other means. Locating device 40 is landed in the cooperative receiver 26*b*, positioning swellable material 38 adjacent to anticipated zone 24*b* and its respective flow section 28*b*.

Within a time prescribed by the particular swellable material 38 and wellbore 12 conditions, swellable material 38 expands from its initial position to a sealing position. In the sealing position, swellable material 38 blocks fluid flow from the exterior of completion assembly 30 into interior 32 and into internal bore 36 of isolation assembly 30.

When it is desired to isolate zone 24*a* through flow section 28*a* a subsequent isolation assembly 30 is deployed. In one embodiment, the subsequent isolation assembly 30 is run into completion assembly 14 and its locating device 40 is mated with receiver connector 44 of the preceding isolation assembly 30. In another method, the subsequent isolation assembly 30 is run into completion assembly 14 and connected via receiver 26*a* positioning it in a isolation position proximate flow section 28*a* and flow zone 24*a*.

Figure 3:
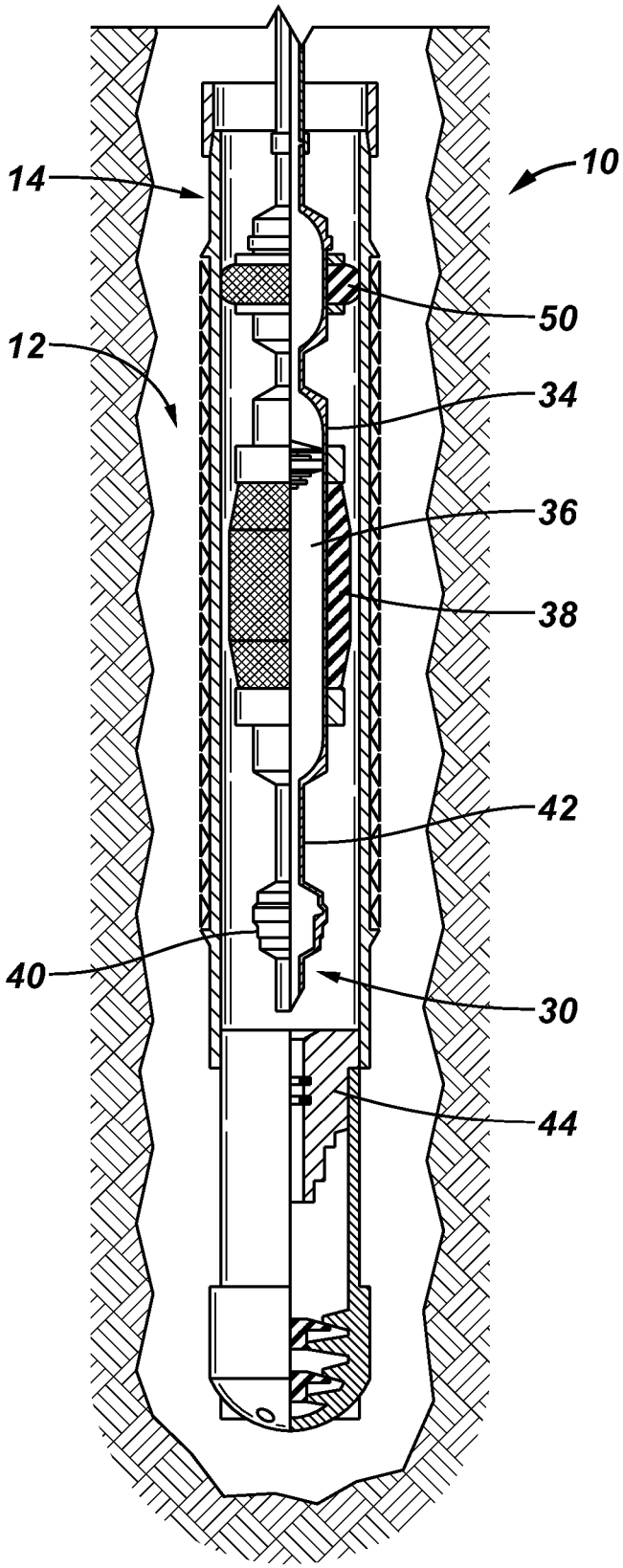
FIG. 3 is a perspective view of a wellbore completed with another embodiment of the isolation assembly of the present invention.

Refer now to FIG. 3, wherein another embodiment of deployable isolation assembly 30 further includes an anchoring device 50. Anchoring device 50 engages completion assembly 14 providing additional anchoring of assembly 30 when needed or desired.

In the illustrated embodiment, anchoring device 50 is an inflatable packer positioned above swellable isolation member 38. It should be noted that other anchoring devices may be utilized. Anchor 50 may be positioned in various locations relative to isolation member 38 to secure isolation assembly 30 to completion assembly 14.

From the foregoing detailed description of specific embodiments of the invention, it should be apparent that a system and method for providing zonal isolation in a wellbore that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A method of providing zonal isolation in a wellbore completion having multiple formation zones, the method comprising the steps of:

identifying, before completing a wellbore, a first anticipated zone and a second anticipated zone to be isolated from other formation zones in the wellbore after the wellbore is placed on production;

selecting, before completing the wellbore, a completion assembly adapted for accepting a first deployable isolation assembly for isolating the first anticipated zone for isolation after completion of the wellbore and after placing the wellbore on production;

providing the first deployable isolation device for the selected completion assembly, the first deployable isolation device having a mandrel having an internal bore and a swellable material disposed on the exterior of the mandrel, wherein the swellable material extends a length sufficient to seal across the first anticipated zone, the first deployable device further comprising a connector adapted for mating with a second deployable isolation device;

providing a second deployable isolation device having an anchoring device adapted for mating with the connector of the first deployable isolation device and a swellable material extending a length sufficient to seal across the second anticipated zone when stacked atop the first deployable isolation device;

completing the wellbore with the selected completion assembly;

positioning, after the wellbore is placed on production, the first deployable isolation assembly in the selected completion system adjacent to the first anticipated zone with the swellable material extending the length of the first anticipated zone;

sealing flow from the first anticipated zone at the interior of the selected completion assembly when the wellbore is on production in response to the swellable material of the first deployable isolation device expanding outward from the mandrel to the completion assembly forming an annular seal across the length of the first anticipated zone;

stacking, later in the production life, the second deployable isolation device atop the first isolation device thereby positioning the respective swellable material across the length of the second anticipated zone; and sealing flow from the second anticipated zone in response to the swellable material of the second deployable isolation device expanding.

2. The method of claim 1, wherein the swellable material of the first and the second deployable isolation assembly expands in response to fluids in the wellbore.

3. The method of claim 1, wherein the selected completion assembly includes a receiver adapted to position the first deployable isolation assembly proximate the first anticipated zone.

4. The method of claim 1, wherein the step of completing includes gravel packing 5. The method of claim 1, wherein the selected completion assembly includes a screen section proximate one or more of the anticipated zones.

6. The method of claim 5, wherein the completion system includes a receiver adapted to position the first deployable isolation system proximate the screen section.

7. A method of providing zonal isolation in a wellbore completion, the method comprising the steps of:

identifying, prior to completing a wellbore, at least a first and a second anticipated zone for isolation in the wellbore after the wellbore is placed on production;

selecting, before completing the wellbore, a completion assembly having a first flow section adjacent to the first anticipated zone, a second flow section adjacent the second anticipated zone, and a receiver adapted to position a first deployable isolation assembly for isolating the first anticipated zone after completion of the wellbore and after placing the well on production;

providing the first deployable isolation device for the selected completion assembly, the first deployable isolation device comprising a mandrel having an internal bore, a swellable material disposed on the exterior of the mandrel extending the length of the first flow section, a locating device matable with the receiver to position the swellable material substantially across the length of the first flow section, and a connector adapted to stack a second deployable isolation device;

providing the second deployable isolation device comprising an anchoring device adapted to mate to with the connector of the first deployable isolation device and a second swellable material having a length to extend across the second flow section;

completing the wellbore with the selected completion assembly and gravel packing;

positioning, after the wellbore is placed on production, the first deployable isolation assembly in the selected completion system adjacent to the first anticipated zone with the swellable material extending the length of the first flow section for isolating the first anticipated zone;

sealing flow from the first anticipated zone at the interior of the selected completion assembly by expanding the swellable material in response to fluids in the wellbore outward from the mandrel to the completion assembly forming a seal across the length of the first flow section;

stacking the second deployable isolation device atop the first deployable isolation device thereby positioning the second swellable material extending across the length of the second flow section; and sealing flow from the second anticipated zone at the interior of the selected completion assembly in response to the second swelling upon contact with fluids in the wellbore.

8. The method of claim 7, wherein the step of completing includes casing the wellbore.

9. The method of claim 7, wherein the completion is an open hole completion.

10. A method for systematically isolating zones in a wellbore over the production life of the well, comprising:

identifying, prior to completing the wellbore, a first zone and a second zone to be isolated after the wellbore is placed on production;

selecting, prior to completing the wellbore, a completion assembly adapted to position a first isolation device to isolate the first anticipated zone;

providing the first isolation device comprising a mandrel, a first swellable material extending the length of the first zone, and a connector adapted to mate with a second isolation device subsequently deployed to isolate the second zone;

providing the second isolation device comprising a mandrel, a second swellable material extending the length of the second zone and an anchoring device adapted to mate with the connector of the first isolation device wherein the second swellable material is positioned across the length of the second zone;

completing the wellbore with the selected completion assembly;

placing the wellbore on production;

landing, after placing the wellbore on production, the first isolation assembly in the completion assembly;

sealing fluid flow from the first zone at the interior of the completion assembly with the first swellable material;

stacking the second isolation device atop the first isolation device; and sealing fluid flow from the second zone at the interior of the completion assembly with the second swellable material.

* * * * *